US006726389B1

(12) United States Patent
Lee

(10) Patent No.: US 6,726,389 B1
(45) Date of Patent: Apr. 27, 2004

(54) PAINT BRUSH ASSEMBLY HAVING TWO-STAGE ANTI-REVERSE EFFECT

(76) Inventor: Kuo-Jium Lee, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/439,916

(22) Filed: May 15, 2003

(51) Int. Cl.[7] ..... B05C 1/00; A46B 11/04

(52) U.S. Cl. ..... 401/197; 401/270; 401/272; 141/127; 141/27; 141/205

(58) Field of Search ..... 401/197, 196, 401/205, 207, 203, 270, 272, 273; 141/127, 21, 27, 20.5; 417/556

(56) References Cited

U.S. PATENT DOCUMENTS 4,695,176 A * 9/1987 Simonette et al. ..... 401/144
4,732,503 A * 3/1988 Bader et al. ..... 401/197
4,810,123 A * 3/1989 Bruggeman ..... 401/144
4,824,272 A * 4/1989 Collins et al. ..... 401/197
5,975,782 A * 11/1999 Lee ..... 401/144

* cited by examiner

*Primary Examiner*—David J. Walczak

(57) ABSTRACT

A paint brush assembly includes a control valve, a first rubber, a control rod, a connecting pipe, and a second rubber. Thus, the paint brush assembly has a two-stage anti-reverse effect, so that the paint contained in the container can be supplied into the barrel conveniently and can be supplied into the connecting pipe conveniently. In addition, the paint brush assembly has a two-stage anti-reverse effect, thereby preventing the paint from leaking.

18 Claims, 5 Drawing Sheets

PAINT BRUSH ASSEMBLY HAVING TWO-STAGE ANTI-REVERSE EFFECT

BACKGROUND OF THE INVENTION

1. Field of the Invention

The present invention relates to a paint brush assembly, and more particularly to a paint brush assembly having a two-stage anti-reverse effect.

2. Description of the Related Art

A conventional paint brush is used to coat the paint on an article so as to protect the surface of the article and to enhance the aesthetic quality of the article. However, when the conventional paint brush is immersed into a barrel containing the paint and is removed outward from the barrel, the paint easily leaking outward, thereby contaminating the floor or the wall.

SUMMARY OF THE INVENTION

The primary objective of the present invention is to provide a paint brush assembly having a two-stage anti-reverse effect, so that the paint contained in the container can be supplied into the barrel conveniently.

Another objective of the present invention is to provide a paint brush assembly having a two-stage anti-reverse effect, so that the paint contained in the barrel can be supplied into the connecting pipe conveniently.

A further objective of the present invention is to provide a paint brush assembly having a two-stage anti-reverse effect, thereby preventing the paint from being exposed and leaked outward.

A further objective of the present invention is to provide a paint brush assembly having a two-stage anti-reverse effect so as to enhance stability of operation of the paint brush assembly.

In accordance with the present invention, there is provided a paint brush assembly, comprising a control valve, a first rubber, a control rod, a connecting pipe, and a second rubber, wherein:

- the control valve has an inside formed with a connecting hole having a first end formed with a first hole and a second end formed with a second hole;
- the control valve has a side formed with a protruding filling block having a first end formed with a through hole and a second end formed with an insertion hole;
- the first rubber has a tapered first end inserted into the insertion hole of the filling block of the control valve;
- the control rod has a first end to seal the through hole of the filling block of the control valve and a second end movably mounted in the control valve;
- the connecting pipe has a first end mounted in the second hole of the control valve; and
- the second rubber has a tapered first end inserted into the first end of the connecting pipe.

Further benefits and advantages of the present invention will become apparent after a careful reading of the detailed description with appropriate reference to the accompanying drawings.

DETAILED DESCRIPTION OF THE INVENTION

Figure 1:
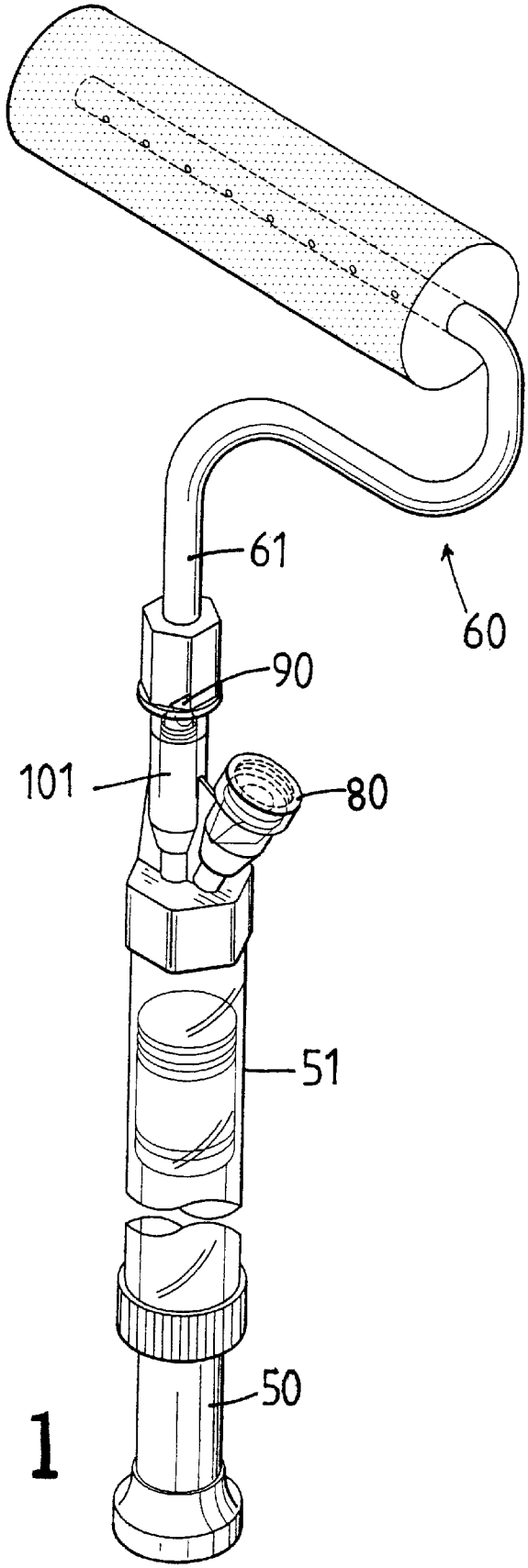
FIG. 1 is a perspective view of a paint brush assembly in accordance with the preferred embodiment of the present invention.
Figure 2:
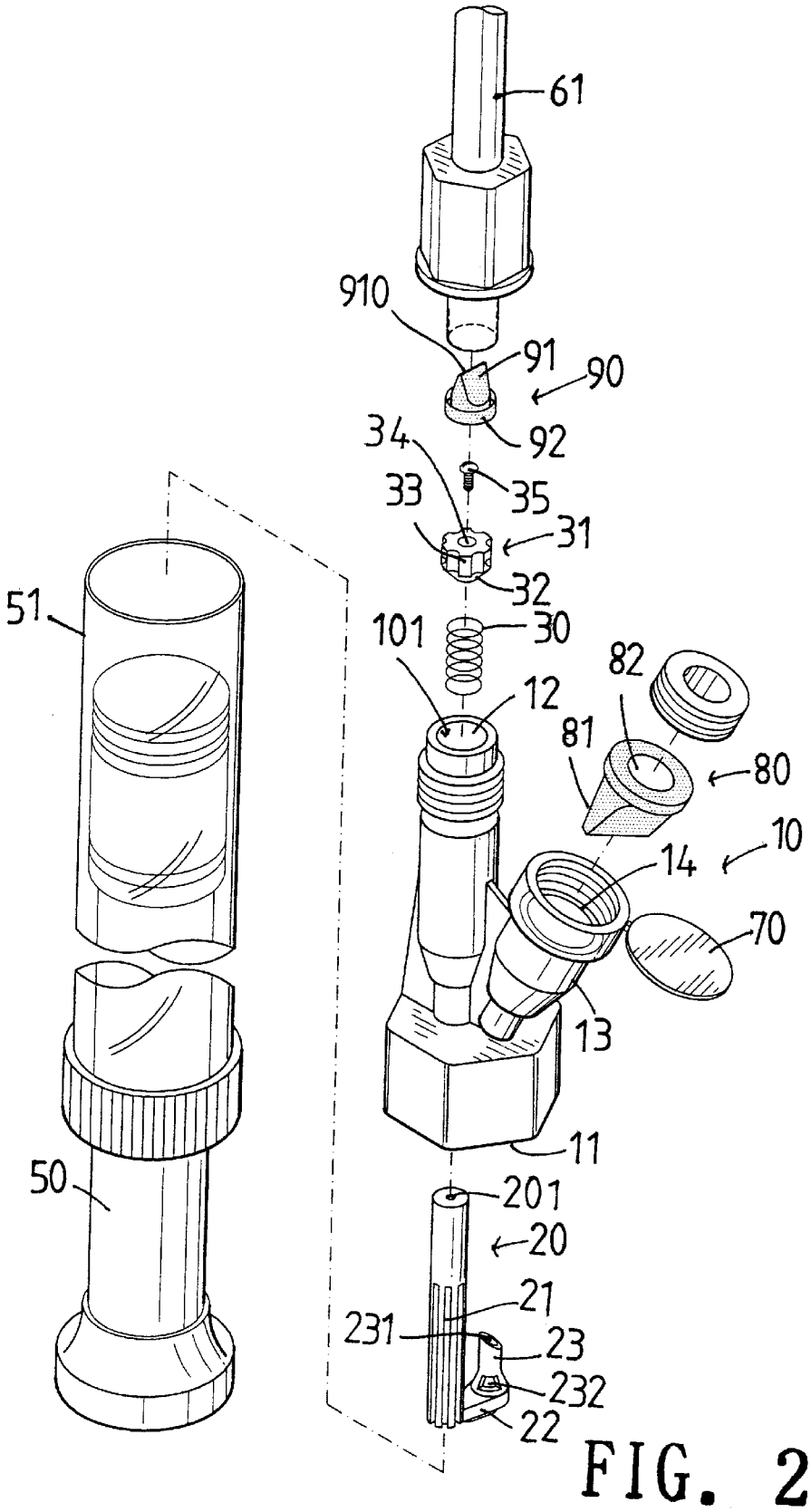
FIG. 2 is an exploded perspective view of the paint brush assembly in accordance with the preferred embodiment of the present invention.
Figure 3:
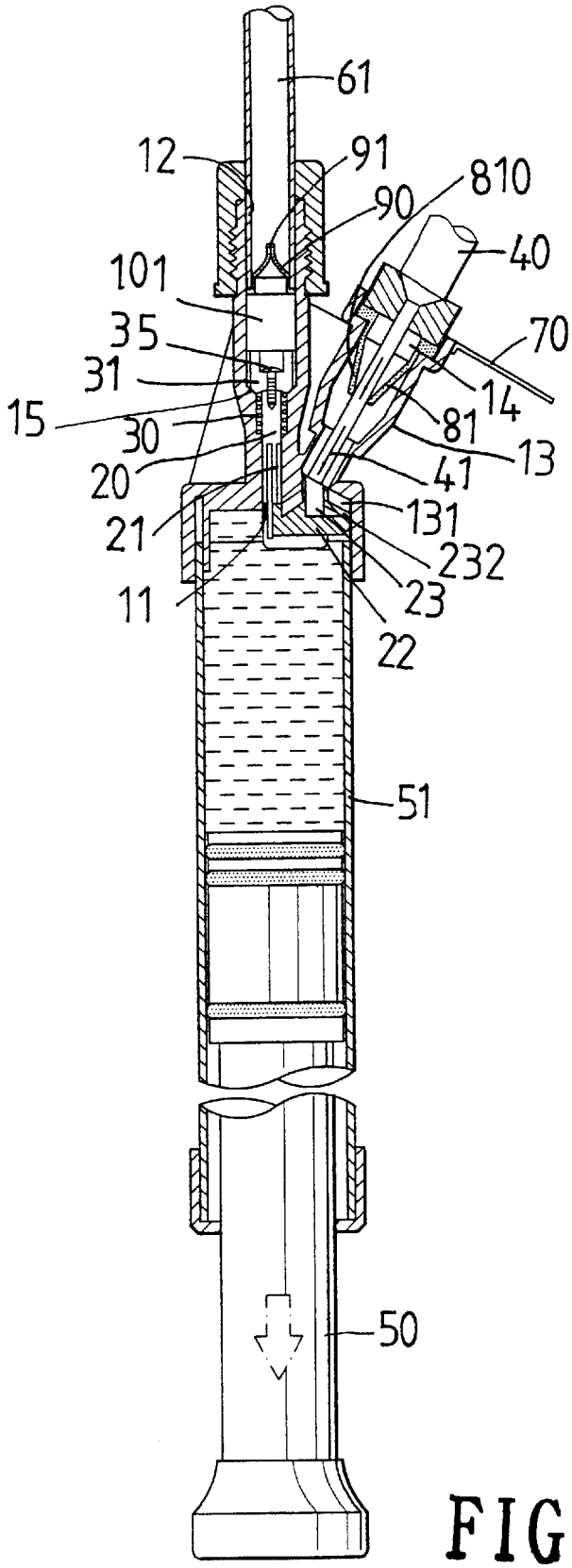
FIG. 3 is a partially cut-away side plan cross-sectional view of the paint brush assembly as shown in FIG. 1.

Referring to the drawings and initially to FIGS. 1–3, a paint brush assembly in accordance with the preferred embodiment of the present invention comprises a control valve 10, a first rubber 80, a control rod 20, a connecting pipe 61, and a second rubber 90.

The control valve 10 has an inside formed with a connecting hole 101 having a first end formed with a first hole 11 and a second end formed with a second hole 12. The inside of the control valve 10 is formed with a neck hole having a reduced diameter and communicated between the first hole 11 and the second hole 12.

The control valve 10 has a side formed with a protruding filling block 13 having a first end formed with a through hole 131 communicating with the connecting hole 101 via the first hole 11 of the control valve 10 and a second end formed with an insertion hole 14 communicating with the through hole 131.

The paint brush assembly further comprises a cover 70 pivotally mounted on the filling block 13 of the control valve 10 to seal the insertion hole 14 of the filling block 13 of the control valve 10.

The first rubber 80 is a hollow body mounted on the filling block 13 of the control valve 10. The first rubber 80 has a tapered first end 81 inserted into the insertion hole 14 of the filling block 13 of the control valve 10. The first end 81 of the first rubber 80 is flexible and is formed with an opening 810 communicating with the through hole 131 of the filling block 13 of the control valve 10. The first rubber 80 has a cylindrical second end 82 rested on the second end of the filling block 13 of the control valve 10.

The control rod 20 is movably mounted in the first hole 11 of the control valve 10 and has a periphery formed with a plurality of elongated slots 21. The control rod 20 has a first end provided with a sealing block 22 to seal the through hole 131 of the filling block 13 of the control valve 10. The sealing block 22 of the control rod 20 is provided with an extension block 23 having an inside formed with a through hole 231 and a periphery formed with an opening 232 communicating with the through hole 231. The control rod 20 has a second end formed with a screw bore 201.

The paint brush assembly further comprises a fixing block 31 secured on the second end of the control rod 20 and movably mounted in the connecting hole 101 of the control valve 10. The fixing block 31 has a periphery formed with a plurality of grooves 33 each communicating with the neck hole 15 of the control valve 10. The fixing block 31 has a side formed with a neck portion 32 having a reduced diameter and mounted in the neck hole 15 of the control valve 10. The fixing block 31 is formed with a through hole 34 aligning with the screw bore 201 of the control rod 20, and the paint brush assembly further comprises a locking screw 35 extended through the through hole 34 of the fixing block 31 and screwed into the screw bore 201 of the control rod 20, thereby fixing the fixing block 31 on the control rod 20.

The paint brush assembly further comprises a spring 30 mounted on the control rod 20 and urged between the fixing block 31 and a wall of the first hole 11 of the control valve 10.

The connecting pipe 61 has a first end mounted in the second hole 12 of the control valve 10 and a second end provided with a brush 60.

The second rubber 90 is a hollow body mounted on the first end of the connecting pipe 61. The second rubber 90 has a tapered first end 91 inserted into the first end of the connecting pipe 61. The first end 91 of the second rubber 90 is flexible and is formed with an opening 910 (see FIG. 5) communicating with the connecting pipe 61 and the connecting hole 101 of the control valve 10. The second rubber 90 has a cylindrical second end 92 rested on the first end of the connecting pipe 61.

The paint brush assembly further comprises an insertion pipe 40 mounted on the second end 82 of the first rubber 80 and having a distal end 41 extended through the first rubber 80 and inserted into the insertion hole 14 of the filling block 13 of the control valve 10 to push and move the extension block 23 of the sealing block 22 of the control rod 20, thereby detaching the sealing block 22 from the through hole 131 of the filling block 13 of the control valve 10, so that the through hole 131 of the filling block 13 of the control valve 10 is connected to the connecting hole 101 of the control valve 10.

The paint brush assembly further comprises a barrel 51 mounted on the control valve 10 and communicating with the first hole 11 of the control valve 10, and a push rod 50 movably mounted in the barrel 51.

Figure 4:
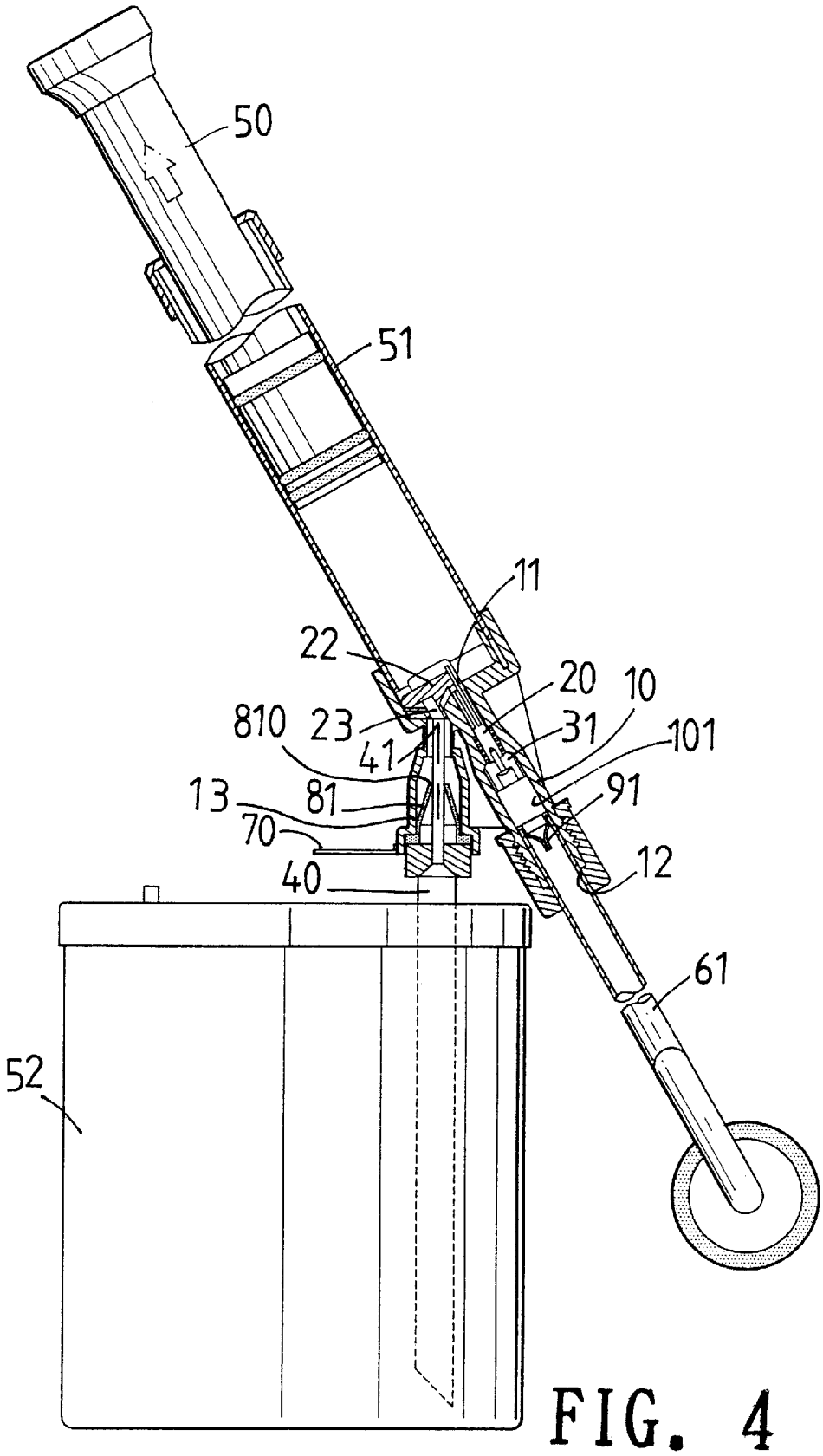
FIG. 4 is a side plan cross-sectional operational view of the paint brush assembly in accordance with the preferred embodiment of the present invention.

In operation, referring to FIGS. 3 and 4, the distal end 41 of the insertion pipe 40 is extended through the first rubber 80 and is inserted into the insertion hole 14 of the filling block 13 of the control valve 10 to push and move the extension block 23 of the sealing block 22 of the control rod 20, so that the control rod 20 is moved to pull the fixing block 31. At this time, the neck portion 32 of the fixing block 31 is moved to block and seal the neck hole 15 of the control valve 10, so as to close connection between the first hole 11 and the second hole 12 of the control valve 10, thereby forming a first-stage anti-reverse effect. Then, the push rod 50 is moved outward relative to the barrel 51 to produce a suction force in the barrel 51, so that the paint contained in a container 52 can be sucked through the insertion pipe 40, the through hole 131 of the filling block 13 of the control valve 10, and the opening 232 of the extension block 23 of the control rod 20 into the barrel 51. At this time, the opening 910 of the first end 91 of the second rubber 90 is closed by the suction force due to its flexibility, thereby forming a second-stage anti-reverse effect, so that the paint contained in the container 52 can be supplied into the barrel 51 conveniently by the two-stage anti-reverse effect.

Figure 5:
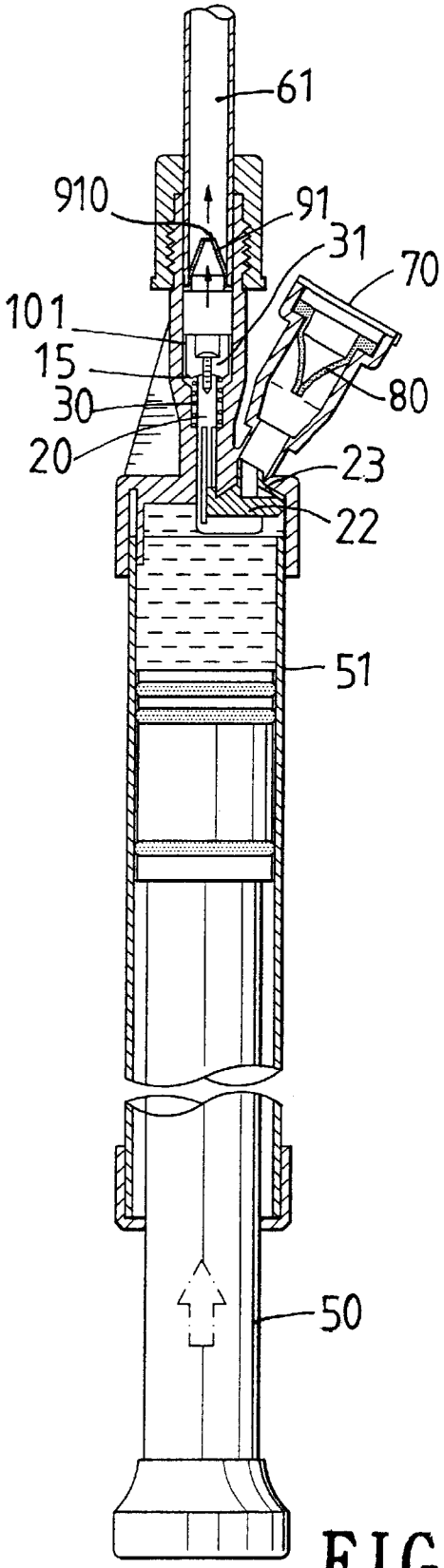
FIG. 5 is a schematic operational view of the paint brush assembly as shown in FIG. 3 in use.

Referring to FIG. 5, the insertion pipe 40 is removed from the filling block 13 of the control valve 10 to detach the distal end 41 of the insertion pipe 40 from the extension block 23 of the sealing block 22 of the control rod 20, so that the force applied on the control rod 20 is released. At this time, the fixing block 31 is pushed to move toward the second rubber 90 by the restoring force of the spring 30, so that the neck portion 32 of the fixing block 31 is also moved to detach from the neck hole 15 of the control valve 10, thereby opening connection between the first hole 11 and the second hole 12 of the control valve 10. At the same time, the control rod 20 is also drawn by the fixing block 31 to move toward the second rubber 90, so that the sealing block 22 of the control rod 20 is also moved to seal the through hole 131 of the filling block 13 of the control valve 10, thereby forming a first-stage anti-reverse effect. In addition, the opening 910 of the first end 91 of the second rubber 90 is opened by disappearance of the suction force due to its flexibility.

Then, the push rod 50 is moved inward relative to the barrel 51 to produce a pushing force in the barrel 51, so that the paint contained in the barrel 51 can be pushed to flow through the neck hole 15 of the control valve 10 and the grooves 33 of the fixing block 31 into the connecting pipe 61 and the brush 60 to achieve the painting function. At this time, the opening 810 of the first end 81 of the first rubber 80 is closed by the pushing force due to its flexibility, thereby forming a second-stage anti-reverse effect, so that the paint contained in the barrel 51 can be supplied into the connecting pipe 61 conveniently by the two-stage anti-reverse effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A paint brush assembly, comprising a control valve, a first rubber, a control rod, a connecting pipe, and a second rubber, wherein:

the control valve has an inside formed with a connecting hole having a first end formed with a first hole and a second end formed with a second hole;

the control valve has a side formed with a protruding filling block having a first end formed with a through hole and a second end formed with an insertion hole;

the first rubber has a tapered first end inserted into the insertion hole of the filling block of the control valve;

the control rod has a first end to seal the through hole of the filling block of the control valve and a second end movably mounted in the control valve;

the connecting pipe has a first end mounted in the second hole of the control valve; and the second rubber has a tapered first end inserted into the first end of the connecting pipe.

2. The paint brush assembly in accordance with claim 1, wherein the through hole of the filling block communicates with the connecting hole via the first hole of the control valve.

3. The paint brush assembly in accordance with claim 1, wherein the first end of the first rubber is flexible and is formed with an opening communicating with the through hole of the filling block of the control valve.

4. The paint brush assembly in accordance with claim 1, wherein the first rubber has a cylindrical second end rested on the second end of the filling block of the control valve.

5. The paint brush assembly in accordance with claim 1, wherein the second end of the control rod is movably mounted in the first hole of the control valve.

6. The paint brush assembly in accordance with claim 1, wherein the control rod has a periphery formed with a plurality of elongated slots.

7. The paint brush assembly in accordance with claim 1, wherein the first end of the control rod is provided with a sealing block to seal the through hole of the filling block of the control valve.

8. The paint brush assembly in accordance with claim 7, wherein the sealing block of the control rod is provided with an extension block having an inside formed with a through hole and a periphery formed with an opening communicating with the through hole.

9. The paint brush assembly in accordance with claim 1, further comprising a fixing block secured on the second end of the control rod and movably mounted in the connecting hole of the control valve.

10. The paint brush assembly in accordance with claim 9, wherein the fixing block has a periphery formed with a plurality of grooves each communicating with the connecting hole of the control valve.

11. The paint brush assembly in accordance with claim 9, wherein the second end of the control rod is formed with a screw bore, the fixing block is formed with a through hole aligning with the screw bore of the control rod, and the paint brush assembly further comprises a locking screw extended through the through hole of the fixing block and screwed into the screw bore of the control rod, thereby fixing the fixing block on the control rod.

12. The paint brush assembly in accordance with claim 9, wherein the inside of the control valve is formed with a neck hole communicated between the first hole and the second hole, and the fixing block has a side formed with a neck portion mounted in the neck hole of the control valve.

13. The paint brush assembly in accordance with claim 9, further comprises a spring mounted on the control rod and urged between the fixing block and a wall of the first hole of the control valve.

14. The paint brush assembly in accordance with claim 1, wherein the first end of the second rubber is flexible and is formed with an opening communicating with the connecting pipe and the connecting hole of the control valve.

15. The paint brush assembly in accordance with claim 1, wherein the second rubber has a cylindrical second end rested on the first end of the connecting pipe.

16. The paint brush assembly in accordance with claim 1, further comprising an insertion pipe mounted on the second end of the first rubber and having a distal end extended through the first rubber and inserted into the insertion hole of the filling block of the control valve to push and move the first end of the control rod, thereby detaching the first end of the control rod from the through hole of the filling block of the control valve, so that the through hole of the filling block of the control valve is connected to the connecting hole of the control valve.

17. The paint brush assembly in accordance with claim 1, further comprising a barrel mounted on the control valve and communicating with the first hole of the control valve, and a push rod movably mounted in the barrel.

18. The paint brush assembly in accordance with claim 1, further comprising a cover pivotally mounted on the filling block of the control valve to seal the insertion hole of the filling block of the control valve.

* * * * *